United States Patent [19]

Tribolet

[11] 4,226,000

[45] Oct. 7, 1980

[54] WET AND DRY VACUUM CLEANING SYSTEM

[76] Inventor: Herbert Tribolet, 2671 Paradise Way, Grand Junction, Colo. 81501

[21] Appl. No.: 14,666

[22] Filed: Feb. 23, 1979

Related U.S. Application Data

[63] Continuation of Ser. No. 803,504, Jun. 6, 1977, abandoned.

[51] Int. Cl.[3] ..... A47L 7/00

[52] U.S. Cl. ..... 15/321; 15/353; 55/185; 55/413

[58] Field of Search ..... 15/320, 321, 353; 55/185, 319, 413

[56] References Cited

U.S. PATENT DOCUMENTS

| | | | |
|---|---|---|---|
| 2,639,005 | 5/1953 | Gerstmann | 15/353 X |
| 2,867,231 | 1/1959 | Gerstmann | 15/353 X |
| 3,618,297 | 11/1971 | Hamrick | 55/319 X |
| 3,747,155 | 7/1973 | Koellisch | 15/322 |
| 3,942,217 | 3/1976 | Bates | 15/353 X |
| 4,055,405 | 10/1977 | Thun-Hohenstein | 15/353 X |

*Primary Examiner*—Christopher K. Moore

[57] ABSTRACT

A hot water extraction system including a water tank having means for connection to a container containing a vacuum motor and to a water extractor and a hot water applicator, the applicator having a connection for attachment to a normal faucet, a hose from the faucet passing through a chemical cleaning solution, and a valve for the emission of a predetermined amount of the water including the solution, the vacuum created by the vacuum motor in the container creating a vacuum in the water tank and thereby providing suction through a hose leading to the water extractor whereby the hot water containing the solution which has been emitted on to a surface such as a rug by the applicator is drawn into the water tank where it is accumulated until the cleansing is completed. There are deflecting means in the water tank whereby the vacuum from the vacuum container draws air from the water tank in one direction while the entry of the water from the extractor is drawn into the tank from another direction so that the said water does not enter the line leading to the vacuum motor. The tank may be so arranged as to be carried on a conventional vacuum canister and is detachable and storable when the apparatus is not being used as a hot water extraction system.

7 Claims, 3 Drawing Figures

WET AND DRY VACUUM CLEANING SYSTEM

This is a continuation of copending parent application Ser. No. 803,504, filed June 6, 1977, now abandoned.

BACKGROUND OF THE INVENTION

Vacuum cleaners for the home and commercial use are a well known commodity and are available in a variety of structures, sizes and shapes including canisters, uprights, etc. In addition, for several years, hot water extraction vacuum units have also been available to provide wet cleaning systems. However, the aforesaid different types of units have been used as simultaneously mutually exclusive cleaners and while many proposals have been made to combine the units, such proposals have not been successful on any commercial scale. In connection with such combination units, difficulties have been encountered involving expense as well as operating difficulties caused by the fact that dust and debris from dry cleaning and the water from the water extraction cleaning caused damage to the vacuum motor and the blower mechanism involved when the units were combined. Furthermore, the proposed solution to the problem involved an independent supply of water to be carried in a separate container which at all times was maintained in proximity to the vacuum tank and in which the chemical solvents required for the water extraction cleaning operation were also carried. Such attempts to combine the features of both the dry and wet cleaning units provided cumbersome and expensive machinery or equipment which was quite difficult to operate and maintain.

SUMMARY OF THE INVENTION

The present invention overcomes all of the foregoing difficulties and presents a structure which uses existing vacuum sources and existing water supplies. In the construction provided, a complete system is presented which can provide both the conventional dry vacuum arrangement and a hot water extraction cleansing system with a minimum of parts and labor. The system contemplates the use of the substantially conventional vacuum canister which is adapted to be moved with facility around various places in the home. This conventional type vacuum canister carries a hose to which various types of cleaning equipment may be attached, such as hand tools, uprights and the like. In accordance with the invention concept, one end of this hose is secured to the vacuum canister while the other end is connected to a tank adapted to carry water which may be of any suitable material such as plastic, metal or of any other water tight construction. The tank has a base portion and a detachable cover portion to facilitate the emptying of the tank when it is filled with water after use. The hose which interconnects the vacuum canister and the water tank may be located in the base portion of the tank or in the removable cover portion, as desired. At the point of its inlet into the tank, the hose is provided with a deflector to deflect the flow of air from the water tank to the vacuum canister in a predetermined direction.

A water extraction unit in the form of an upright which is easily manually manipulable is interconnected to the water tank by means of another hose which leads from the upright to the water tank. A deflector is provided at the point of the inlet of this hose into the water tank for directing the flow of water passing into the tank in any desired predetermined direction. A water applicator is disposed in close proximity to the extraction unit so that the water applied to any surface thereby will be in turn removed from said surface by the extractor. The water applicator may have a head in the form of a spray head for the application of water. A third flexible hose connects the water applicator to any suitable water outlet such as a conventional faucet in the home. Intermediate the faucet or other suitable water outlet and the point of emission of the water from the applicator, suitable means in the form of a container carrying chemicals or the like is provided so that the water passing from the faucet is intermixed with a suitable chemical cleaning solution before its application to the surface to be cleaned.

The invention therefore provides a vacuum container such as a canister which is interconnected to a water tank or the like and the vacuum created in the canister also provides a vacuum condition in the tank. The cleansing solution which has been applied to the surface to be cleaned is then extracted through the extraction unit which is also provided with a vacuum condition because of its interconnection with the water tank. The water then passes into the water tank where it is stored until the tank is filled. A simple dumping operation will suffice to empty the water from the tank.

The invention contemplates the use of a tank for the water which is transportable in tandem with the vacuum canister in a variety of ways. Thus, a removable and detachable separate hot water extraction cleaning system is provided which inexpensively uses conventional vacuum sources and a water supply is conveniently and relatively inexpensively available.

The system is so constructed that the conventional dry vacuum upright or dry vacuum tool attachments may be used when desired by a simple detachment and attachment arrangement.

DETAILED DESCRIPTION OF THE INVENTION

Figure 1:
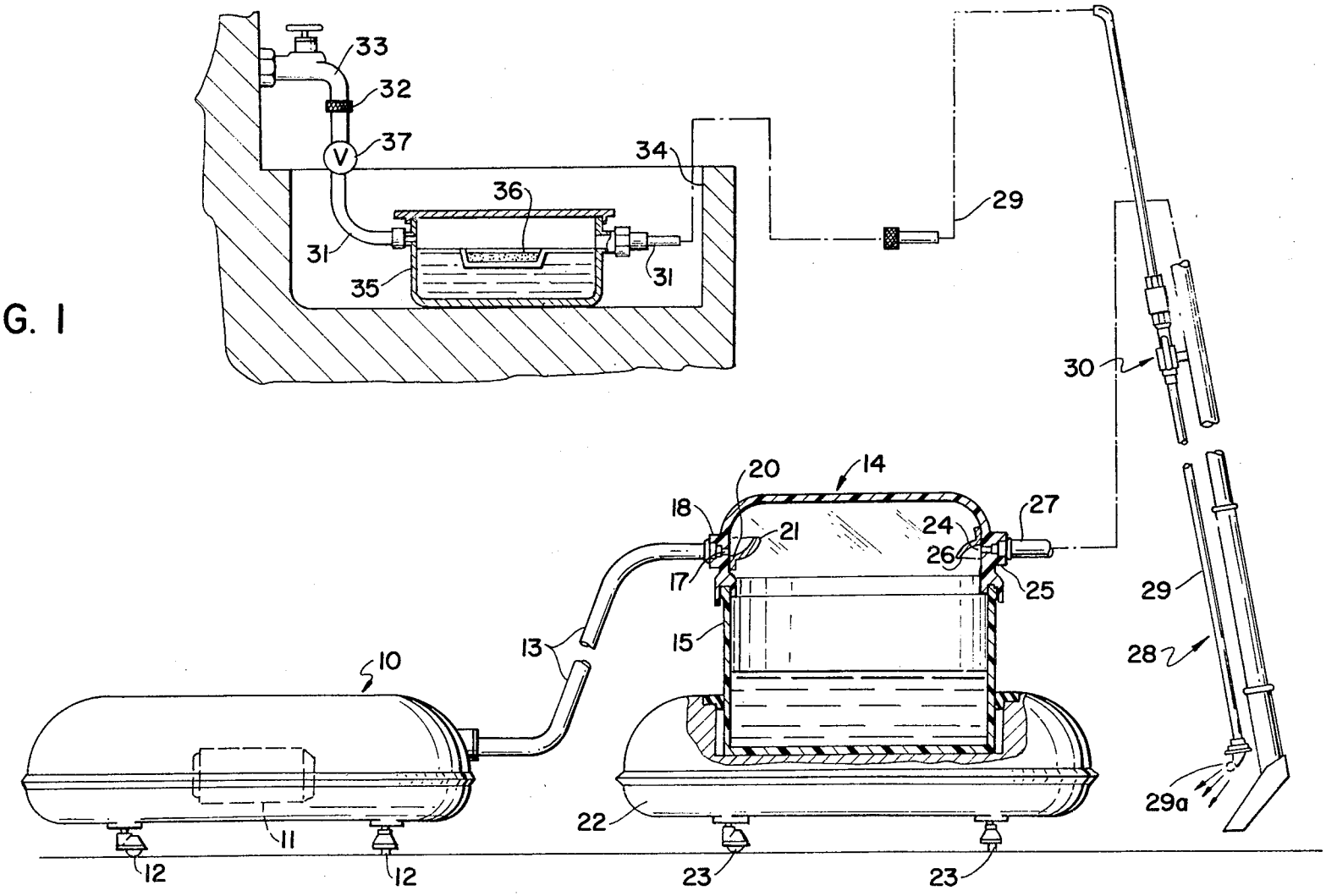
FIG. 1 is a plan view of the various structural elements comprising the hot water extraction system of the present invention.

The system of the invention comprises a vacuum container in the form of a canister 10 which is provided with a suitable vacuum motor 11 and is on, for example, the illustrated wheels 12. The canister may be of any desired shape or material which will enable it to be moved with facility and ease while nonetheless maintaining a vacuum therein.

Attached to the canister is a hose 13 to which is usually attached various hand tools for cleaning furniture, drapes, shelves and the like. This same hose, which is preferably flexible, is utilizable with the present invention.

The concept of the invention involves the presence of a separate tank 14 which, as shown, may comprise a unit having a bottom receptacle portion 15 and a detachable cover 16. Preferably this separable cover is provided so that water and chemicals received in the tank 14 as hereinafter described, may be emptied therefrom when desired. It is, nonetheless, within the purview of the invention to use any suitable means for disposing of the water ultimately received by the tank 14.

In the drawings, an outlet aperture 17 is disposed in the cover portion 16 of the tank. However, while the outlet is located in this position in the illustration, this is merely an example of the disposition of the various parts and the outlet aperture may be otherwise located as for example in the bottom portion, if desired. The aperture carries an outlet pipe 18 which is attached to and coupled with the end 19 of the hose 13 by any fastening means which would provide a suitable sealing fit as, e.g. a frictional connection between the two parts. The inner portion 20 of the pipe 18 has a suitable deflector 21 which is illustrated in the form of a baffle, although an angularly disposed section of pipe or any other suitable structure may comprise the means for this purpose.

The tank 14 is maintained on a movable carriage 22 which is transportable by any means such as wheels 23. When the connection is established between the vacuum canister 10 and the tank 14 through hose 13 the units may be moved in tandem from place-to-place and being of relatively light weight, are movable with ease and facility.

Another part of the tank 15 is provided with a second aperture 24 which accommodates pipe 25. This pipe is also provided with deflecting means 26 which may be the illustrated baffle although an angularly disposed section of pipe or other suitable structure may be used for the purposes hereinafter described. In addition when the term "deflector" or "deflecting" means is used herein, it is intended to include the pipe 18 itself if it is arranged in such fashion as to accomplish the result of preventing the flow of water from the extractor and the water in the tank from entering the vacuum container 10 as hereinafter described. A flexible hose 27 engages the outer end of pipe 25 and leads to a water extractor 28, as shown.

Disposed in proximity to the water extractor 28 is water applicator 29. These parts may be secured together to facilitate the handling thereof. The applicator 29 has a manually manipulatable valve 30 at its upper end whereby the user can control the amount of liquid which is placed on the surface to be cleaned.

The upper end of the applicator carries another hose 31 which is adapted to be affixed by a universal coupling 32 to any suitable water outlet such as the normal faucet 33 of a sink 34. The hose 31 is of such length that it can conveniently reach from the most easily accessible water outlet to any place in the home in which cleaning is taking place and may be simply coupled to and uncoupled from the faucet to accomplish this purpose.

Also located in the line leading from the faucet 33 to the head of the water applicator 29 is a suitable container 35 which may be disposed in the sink 34 or at any other convenient location along the line. The container has therein a solution of any preferable cleaning chemical 36 and as the water passes through the container it picks up and carries with it a certain amount of the cleaning chemical to be emitted upon the surface to be cleaned through the outlet **29*a* of the water applicator 29. A metering valve 37 is locatable within the coupling 32 so that only a predetermined amount of water can pass into the line leading to the outlet 29*a*** for alternate emission and cleaning. Thus, a completely detachable but easily movable apparatus is provided which can utilize the normal water outlet and a relatively conventional vacuum canister for providing the hot water extraction cleaning system of the present invention.

The operation of the system of the present invention is as follows:

When the vacuum motor 11 is energized, a vacuum is created in the canister 10. As a consequence, a vacuum is also drawn into the water tank 14. The vacuum motor, of course, must be of appropriate horsepower to create this vacuum, however many such motors are presently available. The vacuum created in the tank 14 causes a vacuum to be created in the pipe 25 and hose 27 as well as in the extractor tool 28. As is seen, the head of the extractor 28 is in proximity to the applicator 29. Therefore, when a desired amount of liquid containing the cleansing solution is applied to the surface to be cleaned through the spray outlets **29*a*, the suction created in the extractor 28 traveling adjacent thereto causes the solution which has cleaned the surface to which it has been applied to be drawn into the tank 14**.

The deflector 26 serves to deflect the liquid entering the tank 14 away from the vacuum aperture 17 thereby to prevent any of the solution from passing into the hose 13 and consequently into the vacuum motor 11. The deflector 21 also assists in preventing any liquid in the tank from passing into the hose 13 and thereupon into the motor 11.

These deflecting means 26 and 21 are appropriately shown disposed in offset opposed indirect operative flow relation with respect to each other, whereby to serve as flow influencing means for preventing entrained water flowing into the tank 14 from the extractor tool 28 under the prevailing suction vacuum conditions from entering the vacuum container 10.

Deflector 26 thus provides inlet flow directing means in operative coacting arrangement with hose 27 for directing the incoming flow of air and water from the extractor 28 into the water tank 14 along an increasingly expanding and diverging initial fluid velocity deceleration flow path initially relatively remote from the operative level of the water in the tank to enhance the differential flow velocity between the initially incoming flowing air and water and in turn separation of the water from the flowing air while avoiding disturbance of such level of water, whereas deflector 21 conjointly provides outlet flow directing means in operative coacting arrangement with hose 13 for directing the outgoing flow of air from the water tank 14 to the vacuum container or canister 10 along a terminal fluid velocity acceleration flow path relatively remote from said initial fluid velocity deceleration flow path and from such level of water to enhance removal of such air from the water tank while avoiding both entrainment of water into such air and disturbance of the level of such water.

Hence, tank 14 is provided for normally containing water up to a selective maximum operative water level therein under a vacuum condition, which maximum level is inherently below the level of the entry to outlet aperture 17 as at the upper edge of fixedly disposed or stationary deflector 21, whereupon such deflector 21 or the like constitutes appropriate stationary means which are stationarily fixedly disposed relative to such maximum level for preventing water flowing into the tank via the second aperture 24 up to such maximum level under a vacuum condition from entering the vacuum container 10. It is seen that upwardly facing deflector 21 and downwardly facing likewise fixedly disposed or stationary deflector 26 are spatially remotely disposed with respect to each other and in indirect operative flow relation yet each will be stationarily fixedly disposed at a substantially corresponding level spaced relatively remotely above such maximum water level, although the upper edge of deflector 21 understandably will be at a higher level than that of both the corresponding downwardly facing edge of deflector 26 and the second aperture 26. Naturally, since the cover portion 16 of tank 14 will normally be removed for emptying tank 14, such maximum water level will be below the level of the deflectors 21 and 26 in the cover portion, yet where such stationary means are alternatively provided in the bottom portion 15, they will likewise be sufficiently operatively at the upper portion thereof to permit the tank to be filled with water up to an appropriate selective maximum operative water level spaced relatively remotely therebelow, as the artisan will appreciate.

Hence, in essence the stationary means constitute flow direction controlling means 21 and 26 arranged relative to the extending, i.e. horizontal, disposition of the water level in the water tank 14 for controlling the flow direction of the vacuum induced flow into and through the water tank to travel substantially at inclined angles to such extending disposition of the water level, as the artisan will appreciate.

The present invention therefore provides a very efficient construction for utilizing a vacuum receptacle which is adapted to be connected to the water inlet from a convenient water tap and pass through a cleaning chemical for ultimate containment within a separate and disconnectable tank after performing the cleaning operation. The tank, of course, may be easily cleaned after the water is removed from the lower portion 15 and is thereafter easily stored. As a consequence, the relatively inexpensive unit is ready for use when necessary during the portions of the year when major cleaning is undertaken.

For general everyday cleaning in dry form, it is only necessary to make the usual connection between the dry upright broom-like cleaner (not shown) through hose 13 leading from the canister 10 and the system may be utilized as a dry vacuum cleaner.

Figure 2:
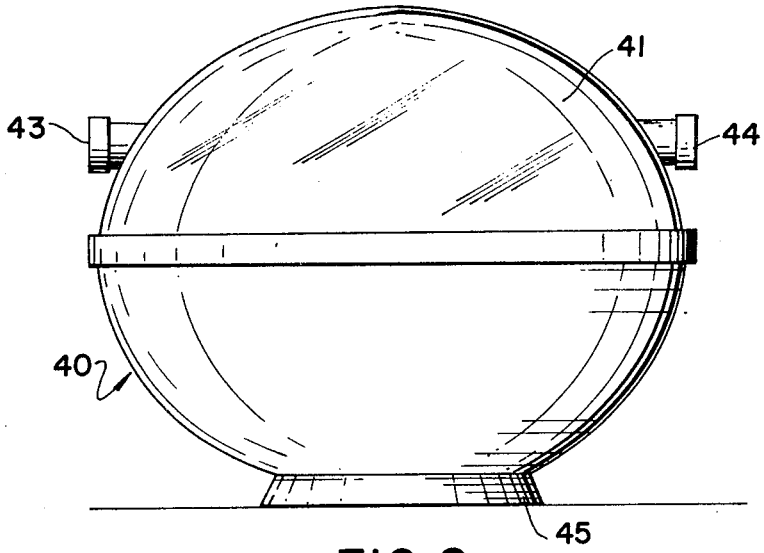
FIG. 2 is a side view of a modified form of the water tank used in the system of the present invention.
Figure 3:
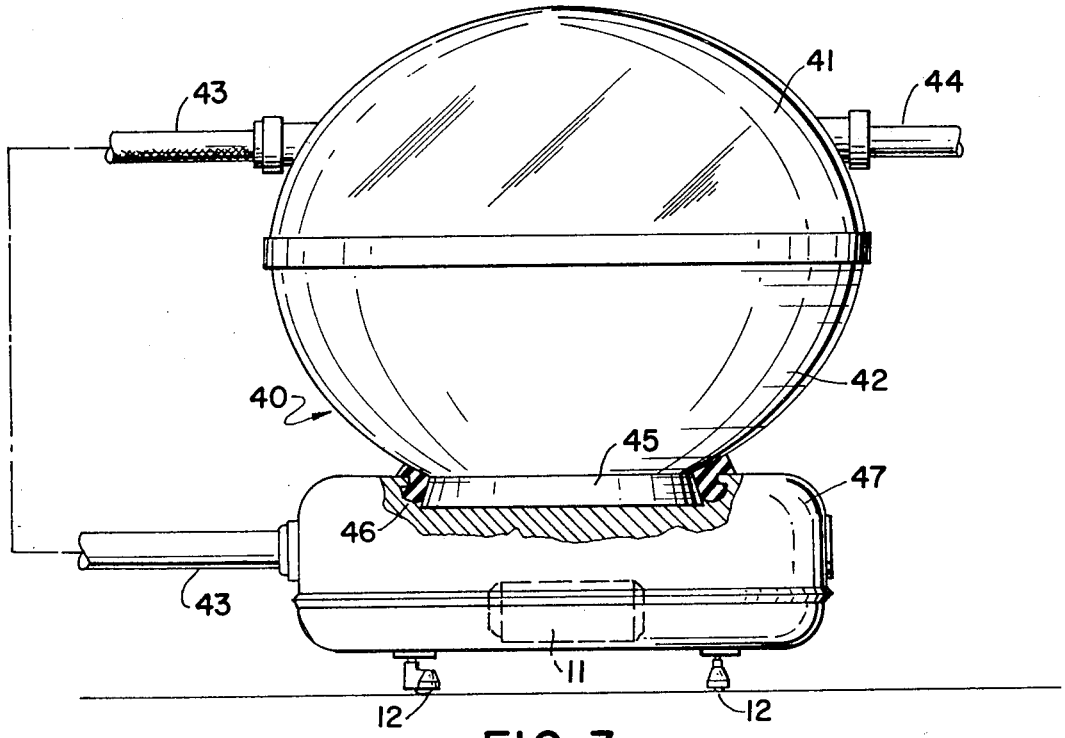
FIG. 3 is a side view of the water tank shown in FIG. 2 disposed on a vacuum container utilizing the system of the present invention.

FIGS. 2 and 3 show a highly attractive and desirable form of the invention in which the separate water tank is carried directly by the vacuum canister instead of in tandem or adjacent thereto. As illustrated, the tank 40 is preferably made of a relatively clear plastic material and is in substantially circular form. The tank 40 comprises an upper half portion 41 which is suitably secured in leak-proof but detachable relation to a lower half portion 42 into which the water emanating from the surface to be cleaned will flow. The hose connection 43 to the canister and the hose connection 44 to the vacuum cleaning tool are in essence identical with the hoses 13 and 17 defined heretofore.

The vacuum tank 40 receptacle functions in the manner heretofore described in connection with tank 14 in FIG. 1. However, as shown, the bottom section 42 of the plastic carrying tank 40 has an integral molded pedestal 45 which fits directly within the cooperating recess 46 formed in the top of the canister 47. Thus, this easily detachable circular plastic container may be easily assembled with the pedestal 45 being placed into the recess 46. Thereafter only one carriage need be moved about when wet cleaning operations are taking place with hot water extraction.

Of course, if desired, the plastic tank 40 having the integral pedestal may be supported on a separate carriage in the same fashion as the tank 14 is carried on a separate carriage as shown in FIG. 1. In this instance the separate carriage would have the appropriate design marking configuration. With this plastic tank, there will be a clear display of the amount of dirt being picked up from the surface of the rug or the like with the cleansing solution passing into the plastic tank after cleaning. Furthermore, this plastic tank may be of a relatively small size as a 14–15" diameter ball would suffice to carry three gallons in the bottom portion alone, which is more than sufficient for normal cleaning operations around a home by the hot water extraction process. When the cleaning has been accomplished, it is only necessary to take the cover lid 41 off after detaching the hose connections and dispose of the water contained in the bottom half whereupon, after cleaning, this attractive plastic tank can be easily stored along with the water extractor and applicator. For decorative purposes, the plastic tank may be of a transparent material or of any desirable color or series of colors depending upon the preference of the user.

It will thus be seen that in the foregoing versions an adaptable, efficient and extremely attractive means has been presented wherein hot water extraction can be accomplished in a connectable and detachable water tank with a minimum of parts while, nevertheless, possessing extreme efficiency and great economy.

While the invention has been described in detail utilizing the above specific examples thereof, it is to be understood that variations and modifications may be made without in any way departing from the spirit of the invention, as defined in the appended claims.

I claim:

1. A hot water extraction system comprising a vacuum container;

a water tank for normally containing water up to a selective maximum operative water level therein under a vacuum condition and including a first hose interconnected to said vacuum container whereby a vacuum condition in the vacuum container provides a corresponding vacuum condition in the water tank;

a water extractor including a second hose interconnected to said water tank whereby a vacuum condition in said water tank provides a corresponding vacuum condition in said water extractor;

stationary flow direction controlling means stationarily fixedly disposed relative to the selective maximum operative water level in the water tank for preventing the water flowing into the water tank from the extractor up to such maximum water level under a vacuum condition from entering the vacuum container, said means being arranged relative to the extending disposition of such water level for controlling the flow direction of the vacuum induced flow into and through the water tank to travel substantially at inclined angles to such extending disposition of the water level;

a water applicator in proximity to said water extractor;

a line for the supply of water comprising a hose adapted to interconnect said water applicator to a conventional remote source of hot water supply; and a valve for metering the amount of water supplied through said water applicator.

2. The hot water extraction system of claim 1 including a container for dispensing cleansing chemicals disposed in the said line leading from the conventional water supply to the water applicator.

3. The hot water extraction system of claim 1 in which the means for preventing water flowing into the water tank from the extractor from entering the vacuum container comprises deflecting means.

4. The hot water extraction system of claim 3 in which said deflecting means comprise first deflecting means in operative coacting arrangement with said first hose for deflecting in a predetermined direction the flow of air from the water tank to the vacuum container; and second deflecting means in operative coacting arrangement with said second hose for deflecting in a predetermined direction the incoming flow of air and water from the extractor into the water tank.

5. The hot water extraction system of claim 4 in which the first and second deflecting means are remotely disposed in indirect operative flow relation with respect to each other.

6. The hot water extraction system of claim 1 in which the means for preventing water flowing into the water tank from the extractor from entering the vacuum container comprise stationary inlet flow directing means in operative coacting arrangement with said second hose stationarily fixedly disposed at a level spaced relatively remotely above the selective maximum operative water level in the water tank for directing the incoming flow of air and water from the extractor into the water tank along an increasingly expanding and diverging initial fluid velocity deceleration flow path initially relatively remote from the operative level of the water in the water tank to enhance the differential flow velocity between the initially incoming flowing air and water and in turn separation of the water from the flowing air while substantially avoiding disturbance of such level of water; and stationary outlet flow directing means in operative coacting arrangement with said first hose spatially remote from the inlet flow directing means and stationarily fixedly disposed at a level substantially correspondingly spaced relatively remotely above such maximum water level for directing the outgoing flow of air from the water tank to the vacuum container along a terminal fluid velocity acceleration flow path relatively remote from said initial fluid velocity deceleration flow path and from such level of water to enhance removal of such air from the water tank while substantially avoiding both entrainment of water into such air and disturbance of such level of water.

7. The hot water extraction system of claim 6 in which the inlet flow directing means and outlet flow directing means are remotely disposed in indirect operative flow relation with respect to each other.

* * * * *